US005940108A

United States Patent [19]

Ito

[11] Patent Number: 5,940,108

[45] Date of Patent: Aug. 17, 1999

[54] PRINTER

[75] Inventor: Akihiko Ito, Chiba, Japan

[73] Assignee: Seiko Instruments Inc., Japan

[21] Appl. No.: 08/893,830

[22] Filed: Jul. 11, 1997

[51] Int. Cl.[6] ..... B41J 2/32

[52] U.S. Cl. ..... 347/197; 347/222

[58] Field of Search ..... 347/197, 198, 347/218, 220, 222; 200/648, 120.16

[56] References Cited

U.S. PATENT DOCUMENTS

| | | | |
|---|---|---|---|
| 4,562,443 | 12/1985 | Matsune et al. | 347/176 |
| 4,913,567 | 4/1990 | Imamaki et al. | 400/120 |
| 5,181,787 | 1/1993 | Hosomi | 400/120.16 |

FOREIGN PATENT DOCUMENTS

| | | | |
|---|---|---|---|
| 61-078681 | 4/1986 | Japan | B41J 25/28 |
| WO 9217341 | 10/1992 | WIPO . | |

OTHER PUBLICATIONS

Patent Abstracts of Japan, vol. 012, No. 126 (M–687) Apr. 19, 1988.

Patent Abstracts of Japan, vol. 017, No. 397 (M–1452) Jul. 26, 1993.

Patent Abstracts of Japan, vol. 010, No. 249 (M–511) Aug. 27, 1986.

Patent Abstracts of Japan, vol. 012, No. 381 (M–752) Oct. 12, 1988.

Patent Abstracts of Japan, vol. 012, No. 315 (M–735) Aug. 26, 1988.

Patent Abstracts of Japan, vol. 008, No. 143 (M–306) Jul. 4, 1984.

Patent Abstracts of Japan, vol. 10, No. 249 (M–511) Aug. 27, 1986.

*Primary Examiner*—N. Le
*Assistant Examiner*—Anh T. N. Vo
*Attorney, Agent, or Firm*—Adams & Wilks

[57] ABSTRACT

A printer comprises a frame, a platen supported by the frame for undergoing rotation, and a printing head for printing on a recording medium fed between the platen and the printing head. The printing head is supported by the frame for undergoing pivotal movement into and out of pressure contact with the platen. A biasing member is mounted for movement between a first position in which the biasing member is in a neutral, unstretched state, and a second position in which the biasing member is in stretched state. The biasing member has a first end integrally connected to the printing head and a second end opposite the first end. An operation member is integrally connected to the second end of the biasing member and is supported by the frame for undergoing pivotal movement between a first position and a second position. When the operation member is pivoted to the first position, the biasing member is moved to the first position and the printing head is pivoted out of pressure contact with the platen. When the operation member is pivoted to the second position, the biasing member is moved to the second position and the printing head is pivoted into pressure contact with the platen.

9 Claims, 4 Drawing Sheets

PRINTER

BACKGROUND OF THE INVENTION

The present invention relates to a printer for printing on recording paper comprising a platen, a head, a spring member, and an opening/closing operation member. More particularly, the present invention relates to a mechanism for pressing a head against a platen and an opening/closing mechanism.

A general construction of a conventional printer is now described briefly in the following. As shown in FIG. 4A, a printer comprises a platen 101 and a thermal head 102. The platen 101 is rotatably supported about an axis 101*a* along the width direction of recording paper (not shown). More specifically, a stepping motor 104 is connected with the axis 101*a* via a train of gears 103. The rotational movement of the stepping motor 104 is decelerated by the train of gears 103 and is transmitted to a rear axis 101*a*, and the platen 101 is appropriately intermittently rotated for paper feed in the direction shown by an arrow in the figure. The thermal head 102 is disposed so as to face the platen 101 from behind via the recording paper. The thermal head 102 is swingably supported on an axis 105. During a printing operation, a printing portion of the thermal head 102 is pressed against the recording paper. With this state maintained, the printing portion is electrically energized to print a line of letters on the recording paper. After the printing of the line, the platen 101 is rotated in the direction shown by the arrow to feed the recording paper. FIG. 4B shows a schematic cross-sectional structure of the printer shown in FIG. 4A. As shown in the figure, the thermal head 102 is disposed so as to face the platen 101 from behind via recording paper 106. When the thermal head 102 is swung in a forward direction (counterclockwise in the figure) about the axis 105 which is in parallel with but different from the axis 101*a* on the side of the platen 101, the printing portion above the axis 105 is pressed against the platen 101. In order to provide the pressing force, a spring member 107 intervenes between the thermal head 102 and a frame 108 of the printer. On the contrary, when the thermal head 102 is swung in a backward direction (clockwise in the figure) against the urging force by the spring member 107, the printing portion of the thermal head 102 is retracted from the platen 101. This operation is carried out when, for example, the recording paper 106 is fed between the platen 101 and the thermal head 102.

In the conventional printer, the spring member 107 is engaged with a portion of the thermal head 102 above the axis 105, and the pressing force of the spring member 107 due to its resiliency presses the printing portion of the thermal head 102 against the platen 101. The spring member 107 presses, for example, a portion in the middle of the paper width of the thermal head 102. However, with this construction, it is difficult to press evenly the printing portion of the thermal head 102 against the platen 101 along the width direction of the platen 101, and a working face between the printing portion and the platen is often one-sided. This causes uneven density of printing and partially blurred printing on the recording paper 106. In particular, when, for example, the platen 101 is not in parallel with the thermal head 102, it is difficult to press evenly the printing portion of the thermal head 102 against the platen 101 with the spring member 107. Further, during a printing condition, the thermal head 102 is constantly pressed against the platen 101 with considerable pressing force. In order to bear this pressing force, the frame 108 is required to have mechanical strength to some extent, and thus, it is difficult to design a smaller and lighter printer. Particularly, when, for example, the recording paper 106 is fed, the thermal head 102 has to be retracted from the platen 101 against the pressing force by the spring member 107. Since great force acts in this operation, the frame 108 is required to have enough mechanical strength to bear the force.

SUMMARY OF THE INVENTION

In order to solve the above-mentioned problems of a conventional printer, the following measures are taken. A printer for printing on a recording paper according to the present invention comprises a platen, a head, a spring member, and an opening/closing operation member as a basic construction. The platen is rotatably supported about a first axis along the width direction of recording paper. The head is disposed so as to face the platen from behind via the recording paper, and when the head is swung in a forward direction about a second axis in parallel with the first axis, a printing portion above the second axis is pressed against the platen. On the contrary, when the head is swung in a backward direction, the printing portion is retracted from the platen. One end of the spring member is engaged with the head below the second axis, and the other end of the spring member is engaged with the opening/closing operation member. The opening/closing operation member can be switchably operated between a closed position and an open position. In the closed position, the opening/closing operation member urges the spring member to the rear to apply torque to the head to swing the head in the forward direction thereby pressing the printing portion against the platen. In the open position, the opening/closing operation member releases the urging force to the spring member and moves the spring member to the front to swing the head in the backward direction thereby retracting the printing portion from the platen.

According to the present invention, the spring member is engaged with a lower portion of the head and applies urging force to the head so as to pull the head to the rear. This urging force applies torque in the forward direction to the head to press the printing portion in an upper portion of the head against the platen. Since the pressing force applied to the head by the spring member is dispersed in the direction of the paper width by adopting a torque transmission mechanism of this kind, the printing portion is pressed evenly against the platen. Further, when the pressing of the printing portion against the platen is released, the tensile force by the spring member may be weakened and the spring member may be moved to the front. Since no excess force is necessary, the frame structure can be made that much lighter and smaller.

DETAILED DESCRIPTION OF THE PREFERRED EMBODIMENTS

Figures 1A, 1B:
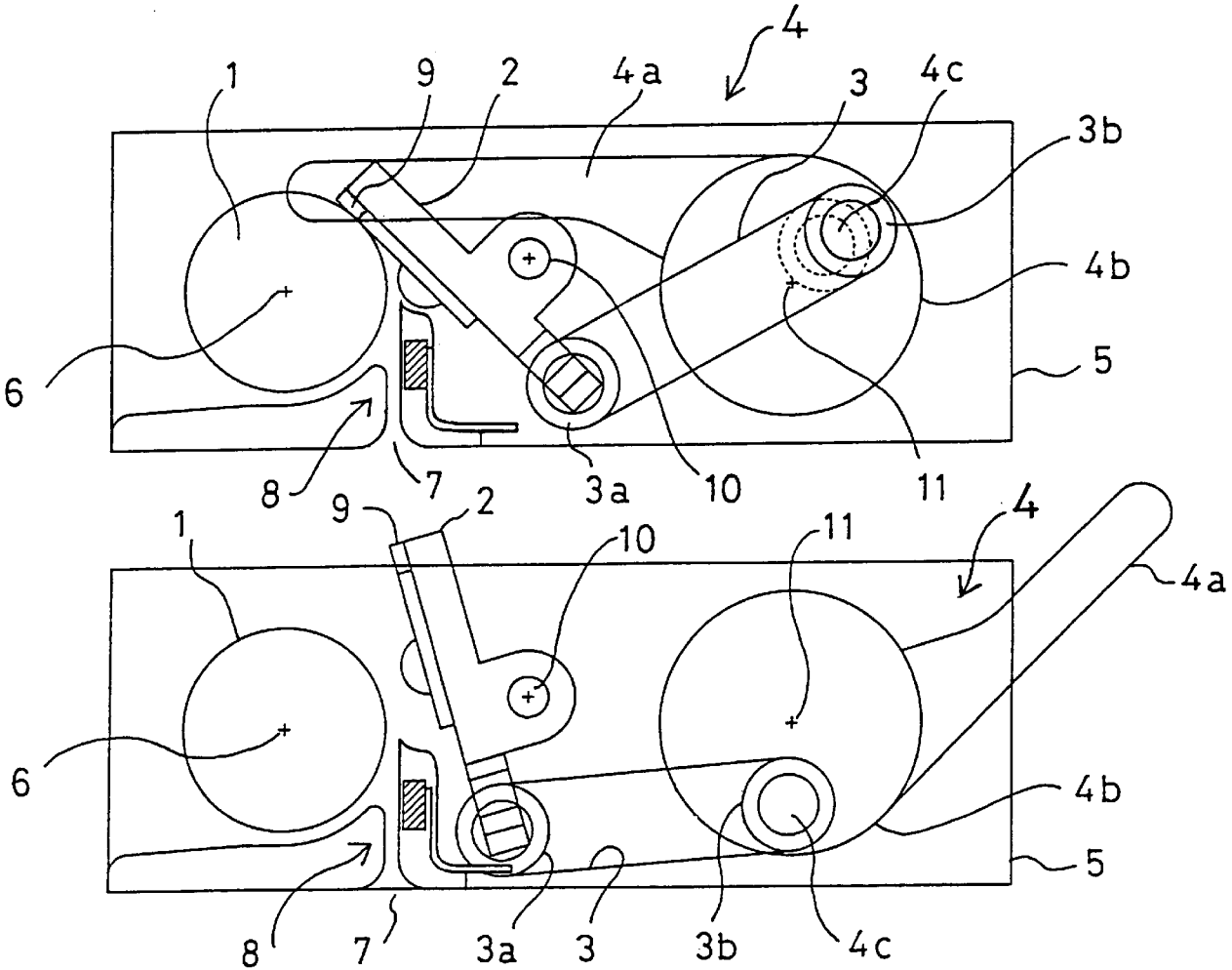
FIG. 1A is a schematic sectional view of a printer according to the present invention showing a construction in an operating condition.
FIG. 1B is a schematic sectional view of the printer according to the present invention showing a construction in an idle condition.

The best mode of the present invention is now described in detail in the following with reference to the drawings. FIG. 1 is a schematic sectional view of a printer according to the present invention showing its basic construction. FIG. 1A shows an operating condition of the printer while FIG. 1B shows an idle condition of the printer. As shown in the figures, the printer comprises a printing platen 1, a (hereinafter referred to as "head") head 2 a biasing or, a spring member 3, and an opening/closing operation member 4, and the printer is assembled using a frame 5. The platen 1 is formed of a cylindrical rubber member or the like and is rotatably supported about a first axis 6 along the width direction of a recording medium or paper (not shown). It is to be noted that recording paper is inserted from a feed path or slit 7 at the bottom of the frame 5 through a guide portion 8 to be supplied between the platen 1 and the head 2 and to be discharged above the frame 5. The head 2 is disposed so as to face the platen 1 from behind via the recording paper. The present printer is a thermal line printer as an example and a printing portion 9 formed of a heater element array is provided in an upper portion of the head 2 along the paper width direction. By electrically energizing the printing portion 9 according to a predetermined data, respective lines of printing are carried out on the recording paper. It is to be noted that the present invention is not limited to a thermal printer but is also applicable to a line printer utilizing other types of heads. The head 2 is swingable in a forward direction and in a backward direction about a second axis 10 in parallel with the first axis 6 of the platen 1. As shown in FIG. 1A, in the operating condition, the head 2 is swung in the forward direction (counterclockwise in the figures), and the printing portion 9 above the second axis 10 is pressed against the platen 1. On the contrary, in the idle condition shown in FIG. 1B, the head 2 is swung in the backward direction (clockwise in the figures) and the printing portion 9 is retracted from the platen 1.

The spring member 3 is formed of a coil spring or the like. One end 3*a* of the spring member 3 is engaged with a central point (FIG. 2) of the head 2 below the second axis 10, and the other end 3*b* of the spring member 3 is engaged with the opening/closing operation member 4. By this construction, the spring member 3 is mounted for movement between a first position in which the spring member is in a neutral unstretched state (FIG. 1B), and a second position in which the spring member 3 is in a stretched state (FIG. 1A). The opening/closing operation member 4 comprises a lever 4*a*, a drum 4*b*, and an eccentric pin 4*c*. The drum 4*b* is rotatable about a third axis 11. The lever 4*a* is attached to one end of the drum 4*b* and the eccentric pin 4*c* is attached to the other end of the drum 4*b*. The eccentric pin 4*c* is planted in a position displaced from the third axis 11. The eccentric pin 4*c* is engaged with the other end 3*b* of the spring member 3. The opening/closing operation member 4 can be switchably operated between a closed position and an open position. FIG. 1A shows the closed position. By pressing down the lever 4*a* so as to be horizontal, the drum 4*b* is swung counterclockwise to be in the closed position. When the opening/closing operation member 4 is in the closed position, it urges the spring member 3 to the rear (second position) to apply torque to the head 2 to swing the head 2 in the forward direction about the second axis 10 thereby pressing the printing portion 9 against the platen 1. More specifically, since the other end 3*b* of the spring member 3 is pulled to the rear by the eccentric pin 4*c*, as shown in FIG. 1A, the spring member 3 is stretched more compared with a neutral condition shown by dotted lines. This urges the lower portion of the head 2 to the rear, and as its reaction, the upper portion of the head 2 is pressed to the front against the platen 1. By adopting a torque conversion mechanism of this kind, the pressing force of the spring member 3 due to its resiliency is transmitted substantially evenly to the upper portion of the head 2 along the paper width direction thereby enabling even and uniform contact of the printing portion 9 with the platen 1. By this, the working face of the printing portion 9 can be prevented from being one-sided, and thus, the printing quality can be greatly improved and snaking of recording paper can be prevented.

On the other hand, as shown in FIG. 1B, when the lever 4*a* is lifted up, the drum 4*b* is rotated in the backward direction about the third axis 11, and this rotation is accompanied by a movement of the eccentric pin 4*c* to the front. As a result, the spring member 3 returns to the neutral condition and moves to the front (first position). In other words, in the open position, the opening/closing operation member 4 releases the urging to the spring member 3 and moves the spring member 3 to the front to swing the head 2 in the backward direction (clockwise) about the second axis 10 thereby retracting the printing portion 9 from the platen 1. In this way, in order to release the pressing of the head 2 against the platen 1 and to open the head 2, the urging force by the spring member 3 may be released, and it is not necessary to, as in a conventional printer, open the head 2 against the urging force by the spring member. Therefore, a mechanical load on the frame 5 can be lightened that much more, and thus, the frame 5 can be made lighter and smaller.

Figure 2:
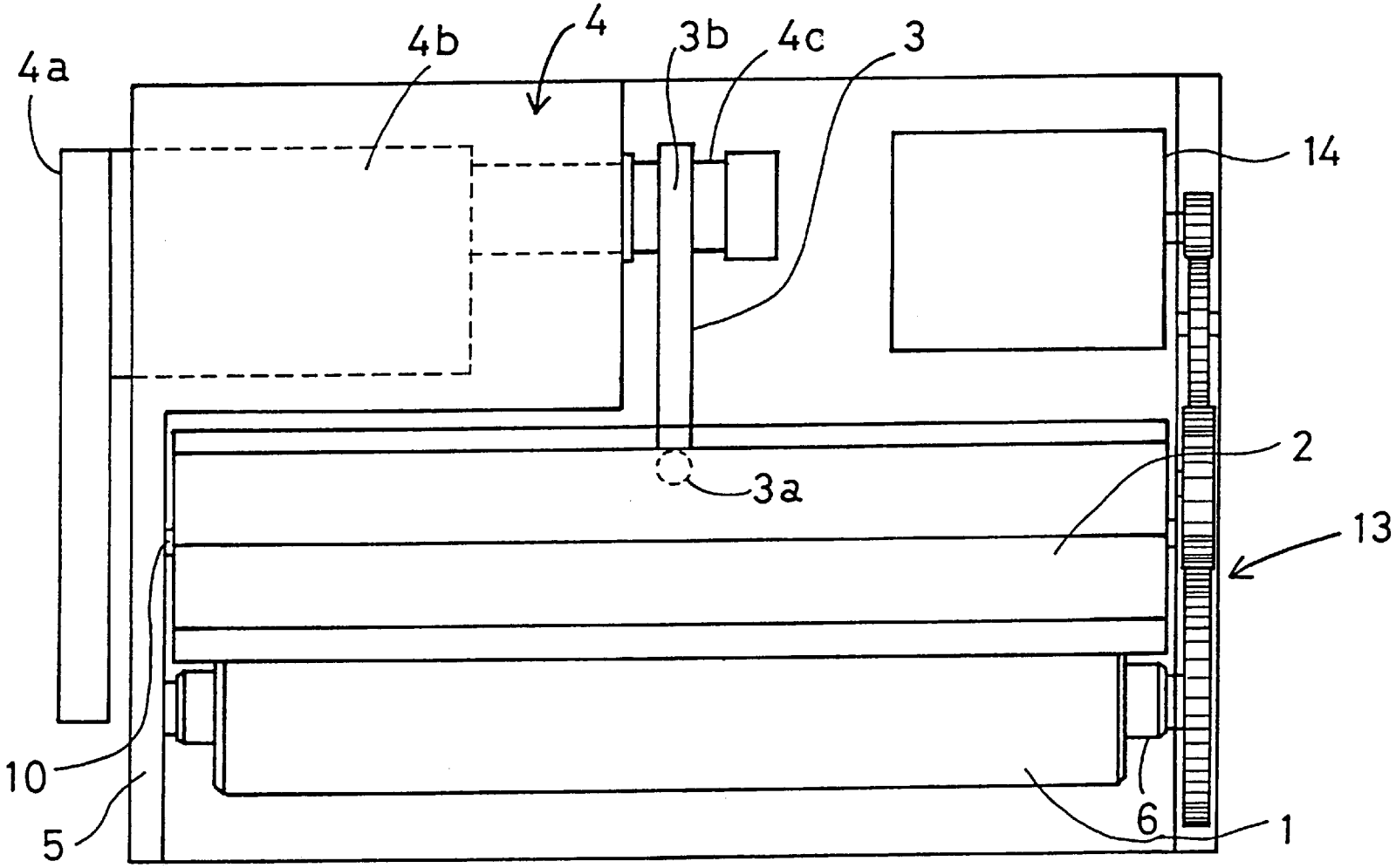
FIG. 2 is a schematic plan view of the printer according to the present invention.

FIG. 2 is a schematic plan view of the printer shown in FIG. 1. The platen 1 is incorporated in the frame 5 and is rotatably supported about the first axis 6. A stepping motor 14 is connected with the first axis 6 via a train of gears 13. The rotational movement of the stepping motor 14 is decelerated via the train of gears 13 and is transmitted to the first axis 6, and the platen 1 is intermittently rotated for paper feed. The head 2 is also incorporated in the frame 5 and is swingably supported about the second axis 10. The lever 4*a*, the drum 4*b*, and the eccentric pin 4*c* integrally form the opening/closing operation member 4, which is also incorporated in the frame 5. The lever 4*a* is manually operated by an operator to be open or closed. The end 3*a* of the spring member 3 is engaged with the lower portion of the head 2 while the end 3*b* of the spring member 3 is engaged with the eccentric pin 4*c* on the side of the opening/closing operation member 4.

Figure 3:
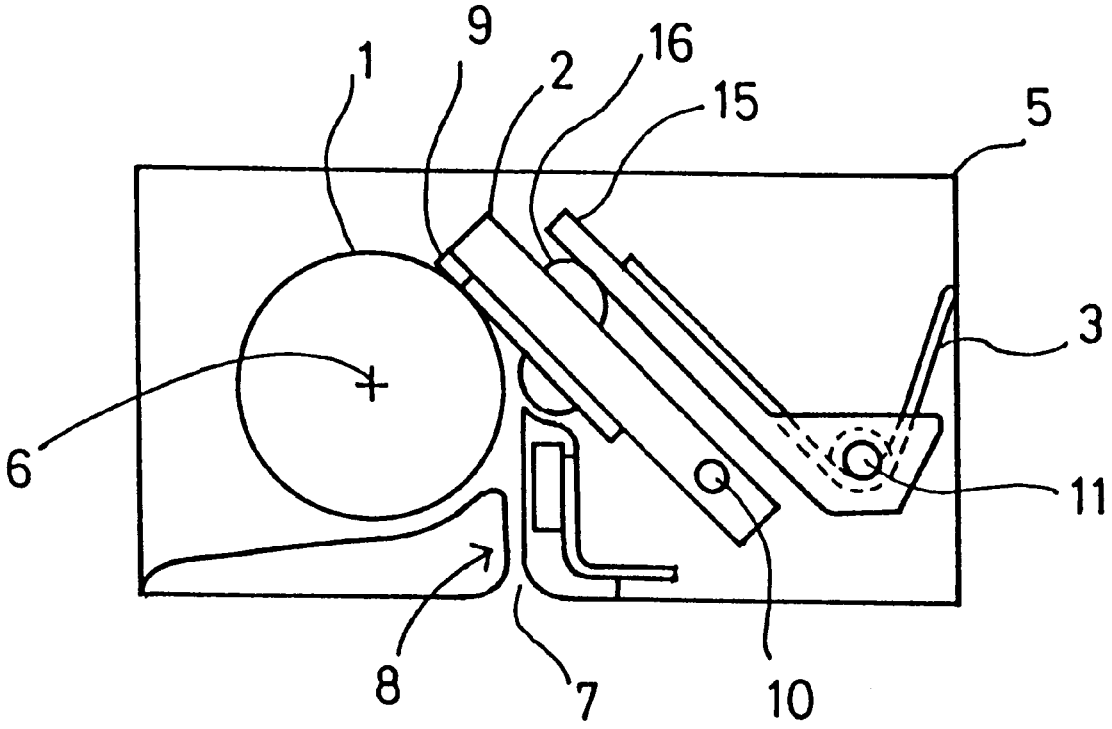
FIG. 3 is a schematic sectional view of a printer as a reference example.
Figure 4B:
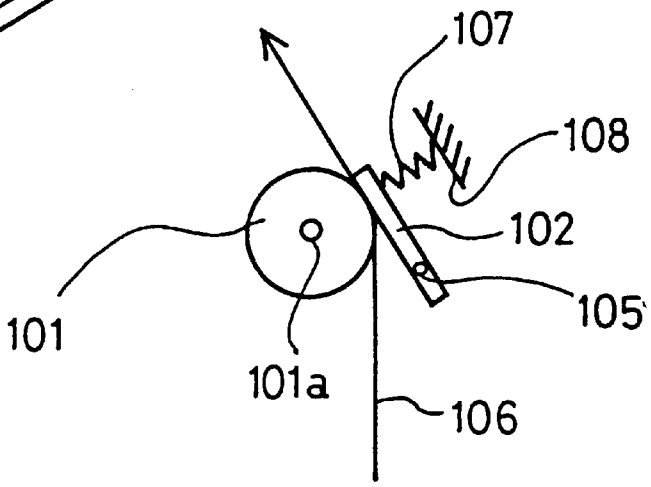
FIG. 4B PRIOR ART
FIG. 4B is a schematic sectional view showing the general construction of the conventional printer.
Figure 4A:
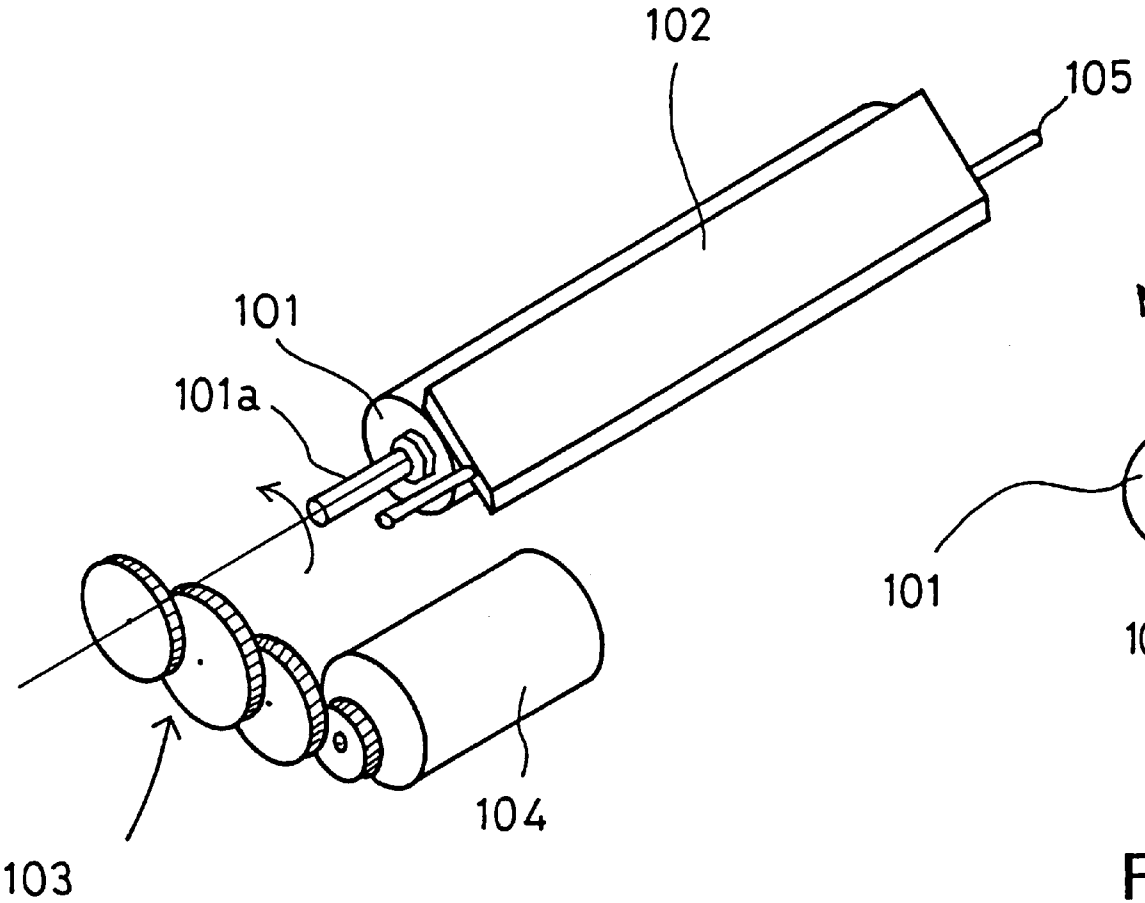
FIG. 4A PRIOR ART
FIG. 4A is a schematic view showing a general construction of a conventional printer.

FIG. 3 is a schematic sectional view showing a reference example of a printer. In FIG. 3, like reference numerals designate like parts in the printer according to the present invention shown in FIG. 1 to facilitate understanding. In the reference example, a pressing plate 15 is incorporated behind the head 2 to be in contact with a protrusion 16 provided at the back of the head 2. The pressing plate 15 is swingable about the third axis 11. The spring member 3 is incorporated in the third axis 11. The spring member 3 presses the pressing plate 15 to the front due to its resiliency, and thus, presses the head 2 against the platen 1 via the protrusion 16. In the reference example, different from the printer according to the present invention, the pressing force of the spring member 3 due to its resiliency is transmitted to the head 2 as it is, and dispersion of the force is not attempted. Therefore, there are cases in which the printing portion 9 of the head 2 is not evenly in contact with the platen 1 resulting in defective printing. Further, in order to open the head 2 with respect to the platen 1, the head 2 is required to be swung about the second axis 10 against the pressing force of the spring member 3 due to its resiliency, and therefore, great force acts on the frame 5.

As described in the above, according to the present invention, one end of the spring member is engaged to the lower portion of the head while the other end of the spring member is engaged with the opening/closing operation member. When the opening/closing operation member is in the closed position, it urges the spring member to the rear to apply torque to the head to swing the head in the forward direction thereby pressing evenly the printing portion against the platen. When the opening/closing operation member is in the open position, it releases the urging force to the spring member and moves the spring member to the front to swing the head in the backward direction thereby retracting the printing portion from the platen. In this way, according to the present invention, different from a conventional printer, the pressing force of the spring member due to its resiliency is not transmitted to the head as it is, but is transmitted to the printing portion of the head after first being converted to torque. Therefore, the pressing force can be dispersed along the paper width direction, the printing portion can be pressed evenly against the platen, and the working face of the printing portion can be effectively prevented from being one-sided. Further, in order to open the head with respect to the platen, the pressing force by the spring member due to its resiliency may just be released, and thus, it is possible to maintain the mechanical strength of the frame low compared to the conventional cases, and it is effective in making the printer lighter and smaller.

What is claimed is:

1. A printer comprising:

a frame;

a platen supported by the frame to undergo rotation about a first axis;

a printing head for printing on a recording medium fed between the platen and the printing head, the printing head being supported by the frame to undergo a pivotal movement into and out of a pressure contact with the platen about a second axis parallel to the first axis;

a biasing member mounted to undergo movement between a first position in which the biasing member is in a neutral unstretched state, and a second position in which the biasing member is in a stretched state, the biasing member having a first end integrally connected to the printing head and a second end opposite the first end; and an operation member integrally connected to the second end of the biasing member and supported by the frame to undergo pivotal movement between an open position and a closed position;

wherein when the operating member is pivoted to the open position, the biasing member is moved to the first position and the printing head is pivoted out of the pressure contact with the platen, and when the operating member is pivoted to the closed position, the biasing member is moved to the second position and the printing head is pivoted into the pressure contact with the platen.

2. A printer according to claim 1; wherein the operation member has a base portion mounted on the frame to undergo the pivotal movement about a central axis of the base portion, an actuating portion integrally connected to the base portion for pivoting the base portion, and a pin portion integrally and eccentrically connected to the base portion.

3. A printer according to claim 2; wherein the second end of the biasing member is integrally connected to the pin portion of the operation member.

4. A printer according to claim 3; wherein the first end of the biasing member is integrally connected to a central point of the printing head.

5. A printer according to claim 2; wherein the actuating portion of the operation member comprises a manually operable lever disposed exteriorly of the frame.

6. A printer according to claim 2; wherein the base portion of the operation member comprises a generally cylindrical-shaped drum.

7. A printer according to claim 1; wherein the operation member is mounted on the frame to undergo the pivotal movement about a third axis; and wherein the second end of the biasing member is integrally connected to the operation member at a connection point which is disposed below the third axis when the operation member is in the open position and the biasing member is in the first position, and which is disposed above the third axis when the operation member is in the closed position and the biasing member is in the second position.

8. A printer according to claim 1; wherein the biasing member comprises a spring for biasing the printing head into the pressure contact with the platen when the spring is in the second position and the operation member is in the closed position; and wherein the printing head is disposed out of the pressure contact with the platen and is free of any biasing force when the spring is in the first position and the operation member is in the open position.

9. A printer comprising:

a frame having a feed path for feeding a recording medium;

a platen rotatably supported by the frame;

a printing head pivotally supported by the frame for a pivotal movement into and out of a pressure contact with the platen for recording printing data on the recording medium;

a biasing member integrally connected to the printing head for applying a biasing force to the printing head to pivot the printing head into the pressure contact with the platen; and means for releasing the biasing force applied to the printing head by the biasing member to pivot the printing head out of the pressure contact with the platen and to place the printing head in a state completely free of any biasing force.

* * * * *